US008222305B2

(12) United States Patent
Jacobson et al.

(10) Patent No.: US 8,222,305 B2
(45) Date of Patent: Jul. 17, 2012

(54) PROCESS FOR PRODUCING LIQUID AND GASEOUS PRODUCTS FROM GASEOUS REACTANTS

(75) Inventors: Paul Jacobson, Sasolburg (ZA); Philip Alex Vogel, Vereeniging (ZA)

(73) Assignee: Sasol Technology (Proprietary) Limited (ZA)

( * ) Notice: Subject to any disclaimer, the term of this patent is extended or adjusted under 35 U.S.C. 154(b) by 382 days.

(21) Appl. No.: 12/674,929

(22) PCT Filed: Aug. 22, 2008

(86) PCT No.: PCT/IB2008/053379

§ 371 (c)(1),
(2), (4) Date: Feb. 24, 2010

(87) PCT Pub. No.: WO2009/027914

PCT Pub. Date: Mar. 5, 2009

(65) Prior Publication Data

US 2010/0273900 A1 Oct. 28, 2010

(30) Foreign Application Priority Data

Aug. 24, 2007 (ZA) ..... 2007/07185

(51) Int. Cl.
*C07C 27/00* (2006.01)
*B03B 1/00* (2006.01)

(52) U.S. Cl. ..... 518/700; 209/12.1

(58) Field of Classification Search ..... 518/700; 209/12.1
See application file for complete search history.

(56) References Cited

U.S. PATENT DOCUMENTS

| | | | |
|---|---|---|---|
| 5,844,006 | A | 12/1998 | Jager et al. |
| 2002/0035163 | A1 | 3/2002 | Vogel et al. |
| 2002/0128330 | A1 | 9/2002 | Anderson |
| 2005/0000861 | A1 | 1/2005 | Clerici et al. |
| 2005/0004238 | A1 | 1/2005 | Clerici et al. |
| 2007/0197667 | A1 | 8/2007 | Vogel |

FOREIGN PATENT DOCUMENTS

| | | | |
|---|---|---|---|
| GB | 2403433 | A | 1/2005 |
| WO | 00/45948 | A | 8/2000 |
| WO | 2007/041726 | A | 4/2007 |

OTHER PUBLICATIONS

International Search Report and Written Opinion issued in connection with corresponding International Application No. PCT/IB2008/053379 on Jun. 2, 2009.

International Preliminary Report on Patentability issued in connection with corresponding International Application No. PCT/IB2008/053379 on Feb. 24, 2010.

*Primary Examiner* — Jafar Parsa
(74) *Attorney, Agent, or Firm* — The H. T. Than Law Group

(57) ABSTRACT

A hydrocarbon synthesis process (10) includes feeding gaseous reactants (18) into a slurry bed (14), allowing the gaseous reactants (18) to react catalytically, thereby to form liquid and gaseous hydrocarbon products, and subjecting a product mixture comprising liquid product and catalyst particles in a filtration stage to filtration, by passing the liquid product through a filtering medium (30) to separate catalyst particles from the liquid product. The gaseous products are withdrawn (23) and cooled to form a multi-phase product which is separated to produce at least a hydrocarbon condensate stream (88) and a tail-gas stream (84). At least a portion of the hydrocarbon condensate stream (88) is treated (96) to remove oxygenated components therefrom, producing a backflush condensate. From time to time, the filtering medium (30) of the filtration stage is backflushed by passing the backflush condensate through the filtering medium (30).

9 Claims, 2 Drawing Sheets

PROCESS FOR PRODUCING LIQUID AND GASEOUS PRODUCTS FROM GASEOUS REACTANTS

THIS INVENTION relates to a process for producing liquid and gaseous products from gaseous reactants.

The inventors are aware of a Fischer-Tropsch slurry reactor in which catalyst and wax are separated using a primary filtration system inside the slurry reactor. In this process, it is necessary from time to time to backflush in order to remove filter cake from filtration surfaces of the primary filtration system to ensure high filtration rates. The Applicant has experienced that in situations where the backflushing medium used for such backflushing is not sufficiently free of catalyst particles, these particles potentially blind the filtration surfaces of the primary filtration system on a downstream side, gradually worsening filtration performance. The term "downstream side" is used with reference to the normal flow of liquid during normal filtration operation. A solution to the aforementioned problem is to pass primary filtrate from the primary filtration system to a secondary filtration system outside the slurry reactor to remove at least a portion of catalyst particles not retained by the primary filtration system. From time to time, secondary filtrate from the secondary filtration system, i.e. wax, is then used as backflushing medium to remove filter cake from filtration surfaces of the primary filtration system. A disadvantage of this approach is that the secondary filtrate used as backflushing medium has to be filtered out again, decreasing the efficiency of the filtration process, as the volume of material to be filtered is increased.

According to the invention, there is provided a hydrocarbon synthesis process for producing liquid and gaseous products from gaseous reactants, which process includes

- feeding, at a low level, gaseous reactants into a slurry bed of solid catalyst particles suspended in a suspension liquid;
- allowing the gaseous reactants to react catalytically as they pass upwardly through the slurry bed, thereby to form liquid and gaseous hydrocarbon products, with the reaction being catalysed by the catalyst particles, and with a product mixture comprising liquid product and catalyst particles being formed;
- subjecting, in a filtration stage, the product mixture to filtration by passing the liquid product through a filtering medium in a first direction to separate catalyst particles from the liquid product;
- withdrawing the gaseous products from above the slurry bed;
- cooling the gaseous products to form a multi-phase product comprising at least a hydrocarbon condensate and a tail-gas;
- separating the multi-phase product to produce at least a hydrocarbon condensate stream and a tail-gas stream;
- treating at least a portion of the hydrocarbon condensate stream to remove oxygenated components therefrom, producing a backflush condensate;
- from time to time interrupting for periods the passage of liquid product through the filtering medium of the filtration stage; and
- backflushing the filtering medium of the filtration stage by passing the backflush condensate through the filtering medium in a second direction opposite to the first direction, for at least a portion of the periods that the liquid product passage is interrupted.

Typically, a cake of catalyst particles is thus allowed to build up on the filtering medium in the filtration stage as a result of the filtration of the liquid product, with the backflushing of the filtering medium then dislodging the cake from the filtering medium.

While the process can, at least in principle, have broader application, it is envisaged that the suspension liquid will normally, but thus not necessarily always, be at least partly composed of the liquid product.

The hydrocarbon synthesis may be Fischer-Tropsch hydrocarbon synthesis, with the gaseous reactants being in the form of a synthesis gas stream comprising mainly carbon monoxide and hydrogen, with the catalyst particles being Fischer-Tropsch catalyst particles, with the multi-phase product comprising at least said hydrocarbon condensate and said tail gas and reaction water, and in which the multi-phase product is separated to produce said hydrocarbon condensate stream and said tail gas stream and a reaction water stream.

The slurry bed will thus be provided in a suitable vessel, e.g. a column, which thus constitutes a reactor, with unreacted reactants and gaseous product being withdrawn from the vessel above the slurry bed. The vessel will be maintained at normal elevated pressure and temperature conditions associated with Fischer-Tropsch synthesis, e.g. a predetermined operating pressure in the range of 10 to 50 bar, and at a predetermined temperature in the range 180° C. and 280° C., or even higher for the production of lower boiling point product.

The catalyst particles can, at least in principle, be any desired Fischer-Tropsch catalyst, such as an iron-based catalyst, a cobalt-based catalyst, or any other Fischer-Tropsch catalyst.

Treating at least a portion of the hydrocarbon condensate stream to remove oxygenated components may include subjecting said portion of the condensate stream to hydrogenation, using a hydrogenation catalyst. Importantly, when hydrogenating the condensate using a hydrogenation catalyst, a catalyst should be selected which does not require dimethyl disulphide injection to maintain the activity of the hydrogenation catalyst, as sulphur is a known poison of Fischer-Tropsch catalysts. Examples of suitable hydrogenation catalysts are nickel-alumina co-precipitated catalysts.

Instead, treating at least a portion of the hydrocarbon condensate stream to remove oxygenated components may include subjecting said portion of the condensate stream to solvent extraction. A suitable liquid-liquid extraction process for oxygenates removal is described in WO 2004/080928, which is incorporated herein by reference.

Treating at least a portion of the hydrocarbon condensate stream to remove oxygenated compounds may include passing said portion of the hydrocarbon condensate stream through a guard-bed to remove oxygenated components from the condensate to a concentration of less than 200 ppm, and preferably less than 1 ppm, depending on the type of oxygenates present. A guard-bed may typically be used together with the solvent extraction as described hereinbefore.

It will be appreciated that at least a substantial portion of the backflush condensate will leave the reactor as a vapour and form part of the gaseous product. The Applicant believes that it is not essential that the backflush condensate be in a liquid state when passing through the filtering medium of the filtration stage during backflushing. However, it may be preferable that a major portion of the backflush condensate is in a liquid state when passing through the filtering medium of the filtration stage during backflushing.

The process may thus include, in a separation stage, separating lighter components from the backflush condensate to form a lights removed backflush condensate, and then using the lights removed backflush condensate for backflushing. The separation stage may include at least one distillation operation.

The filtration stage may be a primary or only filtration stage producing a primary or only filtrate. Typically, the process however includes subjecting the primary filtrate in a secondary filtration stage, to secondary filtration to separate at least a portion of catalyst particles remaining in the primary filtrate. The primary filtrate thus typically includes the liquid product and some catalyst particles.

Any suitable filtering medium can, at least in principle, be used in the primary filtration stage. The filtering medium may be part of a filter cartridge or element mounted in the vessel, and may be of a type which is of elongate form, with the filtering medium being of cylindrical form and enclosing a filtrate collecting zone, and with a filtrate outlet for withdrawing primary filtrate being provided at one end thereof. Thus, the filtering medium can be that of a candle filter. The filtering medium is preferably of a type or construction so that permanent clogging or impregnation thereof with the catalyst particles does not readily occur. Thus, the filtering medium can be a mesh, e.g. a woven mesh; a porous material such as a ceramic material; a perforated sheet; spiral wire wound, e.g. from wedge wire, or the like.

In one embodiment of the invention, the primary filtration stage may be located externally; i.e. outside the slurry bed, e.g. outside the reactor. However, in another embodiment of the invention, the primary filtration stage may be located internally, i.e. inside the slurry bed.

When the primary filtration stage is located internally, a plurality of the filter elements, located at the same or different levels within a filtration zone, may be provided. The filtration zone may be provided anywhere below the upper surface of the slurry bed. The filter elements may be arranged in a plurality of banks, with each filter bank comprising a number of the filter elements.

In principle, the elements can be located at any desired inclination; however, they are preferably located vertically and most preferably with their primary filtrate outlets directed downwardly.

The passage of the primary filtrate passing through the filtering media may be effected by applying a pressure differential across the filtering media and any cake build-up thereon. Preferably this pressure differential may be up to 8 bar, and is typically in the region of between 1 bar and 4 bar. The pressure differential may be effected by withdrawing the primary filtrate into a primary filtrate collection vessel which is at a lower pressure than the reactor vessel, with the filtrate outlets of the filter elements being connected to the primary filtrate collection vessel by means of suitable primary filtrate conduits. The conduits may include a first filtrate conduit leading from the filtrate outlet of each filter element; a second filtrate conduit into which the first conduits of all the filter elements of the particular bank of filter elements tie; and a third filtrate conduit leading to the primary filtrate collection vessel, with the second conduits all tying into the third conduit.

The secondary filtration stage will normally be located outside the reactor. The secondary filtration stage may be provided by any filtration means capable of removing at least a portion of catalyst particles remaining in the primary filtrate. Typically, it may be provided by a pressure leaf filter, in particular a vertically or horizontally orientated pressure leaf filter.

A secondary filtrate collection vessel may be provided downstream of the secondary filtration stage.

Typically, a backflush condensate vessel is provided to receive and hold backflush condensate, and from which the backflush condensate is taken for backflushing the filtering medium.

The backflushing may, in general, be effected in pulse-like fashion. Thus, the backflushing may comprise an initial pulse of backflush condensate, optimally followed by one or more further pulses of backflush condensate. Each backflushing pulse may comprise initiating backflushing rapidly, i.e. commencing flow of backflush condensate rapidly; and backflushing the filter elements rapidly with a volume of the backflush condensate. This volume of backflush condensate, for the initial pulse, may be relatively large. For example, in one embodiment of the invention, the volume of backflush condensate may then, for the initial pulse be approximately equivalent to the internal volume of the filter elements being backflushed. However, in one embodiment of the invention, an even larger volume of backflush condensate can be used for the initial pulse, e.g. more than three times the combined internal volume of the filter elements being backflushed. The nature of any further backflushing pulses that are used, may be similar to that of the initial pulse hereinbefore described. The volume of backflush condensate used during any further backflushing pulse may be similar to, or smaller than, that of the initial backflushing pulse.

However, the volume of backflush condensate used during the initial backflushing pulse can, in certain cases, be less than the internal volume of the filter elements, e.g. less than half their internal volume. The volume of backflush condensate used during a further or second pulse may then be similar to that of the initial pulse. The nature of any further pulses, when utilised, and the volume of the backflush condensate used during such pulses, may be similar to those of the second pulse.

The pressure differential across the filtering media and any filter cake present during backflushing may be up to 10 bar depending on the degree of clogging or age of the filtering media, and is typically at least 1 bar higher than the filtration pressure differential.

The backflush condensate flux during backflushing may be at least 6000 $l/h/m^2$ of filtering media. Thus, the backflush condensate flux may be about 6000 $l/h/m^2$ of filtering media when the pressure differential across the filtering media is about 5 bar, and between 10000 and 12000 $l/h/m^2$ when the pressure differential is about 10 bar.

The process preferably includes subjecting the filtering medium to a waiting period following dislodging the cake of catalyst particles from the filtering medium by backflushing during which no filtering or backflushing takes place, i.e. during which there is no liquid flow through the filtering media of the elements, to enhance subsequent filtration. The waiting period may be up to 60 minutes, or even longer, but is typically less than 30 minutes, and can even be less than 1 minute.

It has been found that cleaning of the filter element surfaces is considerably improved, thus enhancing subsequent filtering performance thereof, when backflushing is effected for at least a sufficiently long period of time to displace substantially all the primary filtrate, from the filter elements, and to ensure that substantial backflushing of the filter elements with backflush condensate takes place. As hereinbefore described, this can be achieved if backflushing is effected for a sufficiently long period of time so that the total volume of the backflush condensate is in excess of three times the combined internal volume of all the filter elements being backflushed.

The backflushing may be effected using backflushing means. In some embodiments of the invention, some of the primary filtrate conduits may form part of the backflushing means, thus also constituting flushing conduits along which backflush condensate is passed. Naturally, if desired, the backflushing means may instead comprise a separate system or arrangement of flushing conduits, which feeds backflush condensate to the filter elements.

The backflushing means may include at least one quick opening valve or the like, for effecting the backflushing pulses, in one of the flushing conduits; and pressurising means for pressurising the backflush condensate vessel. Thus, backflushing may be effected by pressurising the backflush condensate vessel when the vessel contains backflush condensate, and then actuating the quick opening valve until the desired volume of backflush condensate has passed through the filter elements of a bank of the filter elements in the second direction. Instead of utilising a pressurised flushing liquid vessel, a pump can be used for supplying the backflush condensate to the filter elements.

To inhibit settling of the catalyst particles in the slurry bed, the process may include agitating the slurry in the slurry bed. The agitation may include allowing slurry in the slurry bed to pass downwardly from a high level to a lower level, through at least one downcomer. Preferably, the slurry may be allowed to pass downwardly through at least one downcomer located in a first downcomer region of the slurry bed, as well as through at least one further downcomer located in a second downcomer region of the slurry bed, with the second downcomer region being staggered vertically with respect to the first downcomer region, so as to redistribute the catalyst particles within the slurry bed, as taught in ZA 98/5992/PCT/IB98/02070 which is hence incorporated herein by reference. Thus, the downcomer(s) serve(s) to impart a nett upward liquid velocity to the slurry bed in the regions of the slurry bed outside the downcomers thereby maintaining the catalyst in near uniform suspension.

The process may include operating the column such that the slurry bed is in a heterogeneous or churn-turbulent flow regime and comprises a dilute phase consisting of fast-rising large bubbles of gaseous reactants, and possibly gaseous products which transverse the reaction zone or slurry bed virtually in a plug flow manner and a dense phase comprising liquid phase, i.e. liquid product, solid catalyst particles and entrained smaller bubbles of gaseous reactants and gaseous product.

By passing or recirculating some of the slurry through the downcomers, more uniform redistribution of the catalyst in the slurry bed is achieved, than is the case without such downcomers. The catalyst particles in the slurry bed are thus maintained in suspension by the turbulence created by the synthesis gas stream passing through the slurry bed combined with an upward liquid velocity induced by the presence of the downcomers. It was found that the use of downcomers to keep the catalyst particles in uniform suspension, avoids the problem of catalyst settling when selecting the optimum catalyst particle size distribution.

The invention will now be described by way of example with reference to the accompanying drawings.

Figure 1:
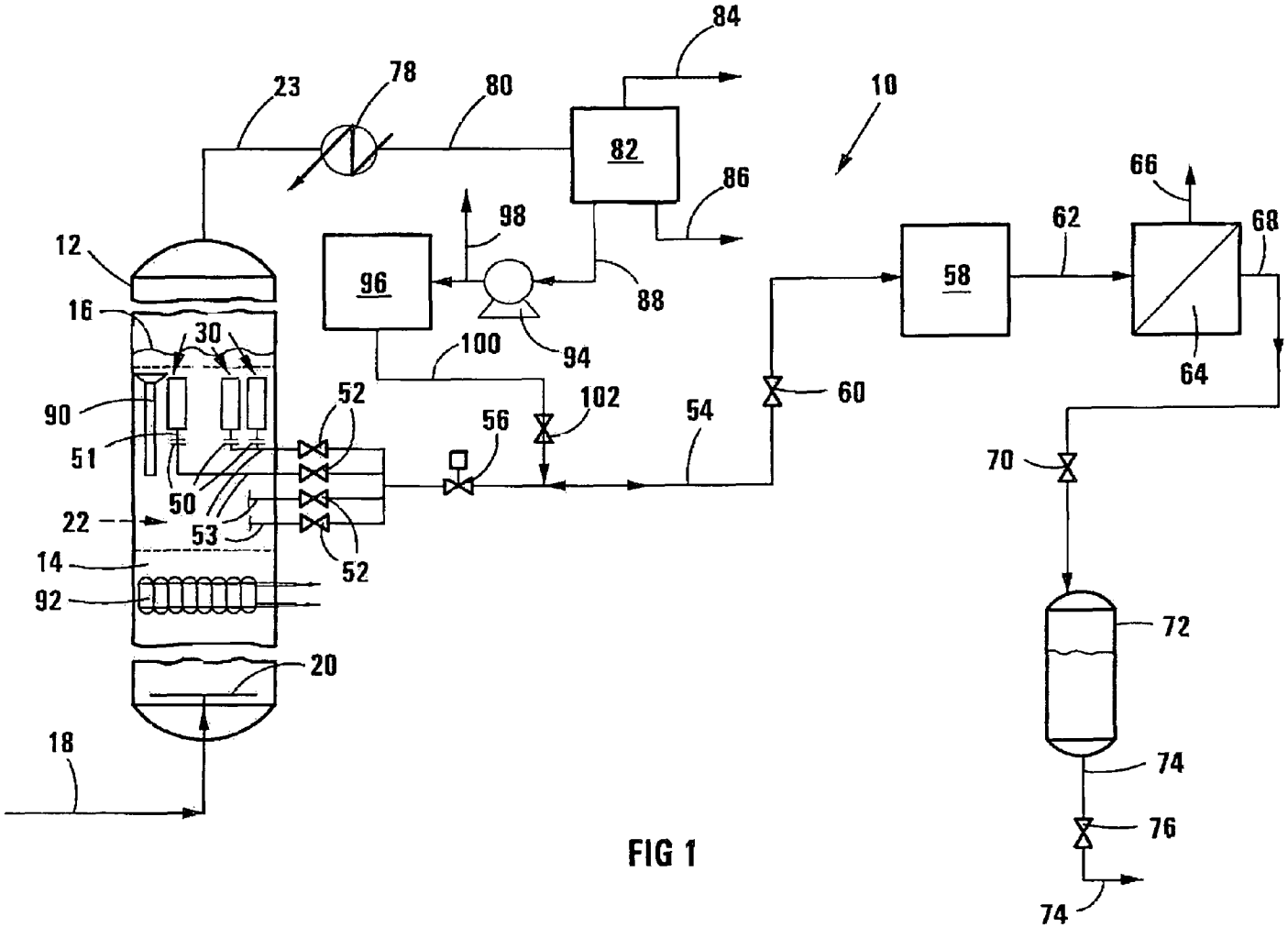
FIG. 1 shows a simplified flow diagram of a process according to the invention for producing liquid and gaseous hydrocarbon products from gaseous reactants.
Figure 2:
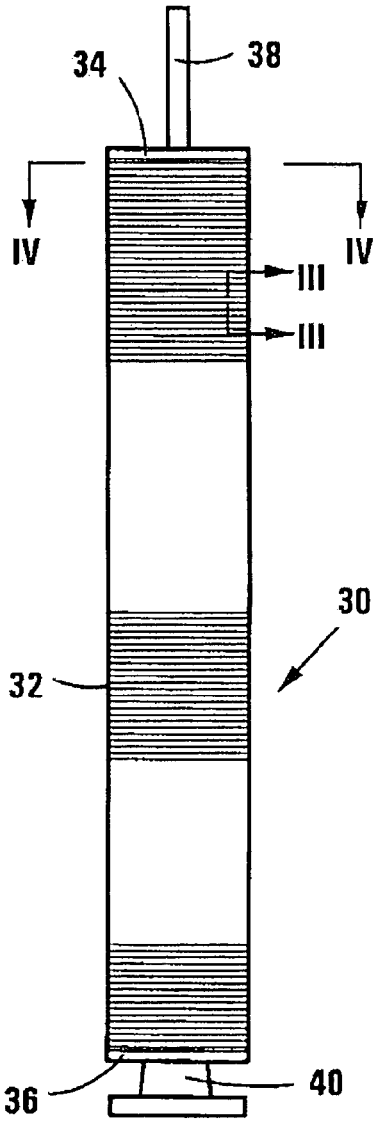
FIG. 2 shows an enlarged side view of one of the filter elements shown in FIG. 1.
Figure 3:
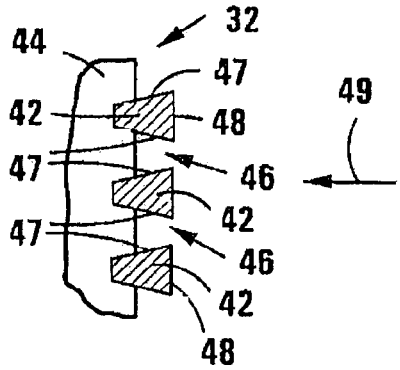
FIG. 3 shows, in part, an enlarged sectional view through III-III in FIG. 2.
Figure 4:
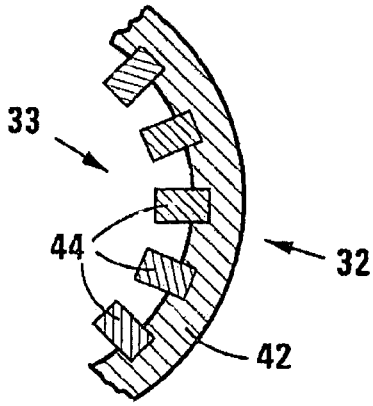
FIG. 4 shows, in part, a sectional view through IV-IV in FIG. 2.

In the drawings, reference numeral 10 generally indicates a process according to the invention for producing liquid and gaseous hydrocarbon products from gaseous reactants.

The process 10 includes an upright cylindrical Fischer-Tropsch synthesis slurry phase reactor vessel 12.

The vessel 12 provides a slurry bed zone normally containing a slurry bed 14 of catalyst particles suspended in liquid product and through which gas is passing, as described in more detail hereunder. The slurry bed 14 has an upper surface 16.

A synthesis gas flow line or conduit 18 is connected to a gas distributor 20 provided at the bottom of the vessel 12, while a gas withdrawal flow line or conduit 23 leads from the top of the vessel 12.

The process 10 also includes a plurality of candle filter elements 30 (only some of which are shown) located in a filtration zone 22 within the slurry bed 14, arranged in a plurality of banks. Each filter element 30 is of elongate cylindrical form, and comprises a cylindrical filtering medium 32 enclosing a filtrate or liquid collecting zone 33. The medium 32 is located between an end plate 34 and a support ring 36. A mounting rod 38 protrudes from the end plate 34, while a flanged liquid outlet 40 is provided on the support ring 36. Thus, by means of the outlet 40, primary filtrate can be withdrawn from the collecting zone 33 of the element or cartridge 30. The elements 30 are mounted in position in the vessel 12 by means of the rods 38 and the flanged outlets 40. This mounting is not shown in detail in the drawings, but is typically effected by connecting the rod 38 to a lattice or grid spanning the vessel 12, while the outlet is connected to a conduit as hereinafter described.

The filtering medium 32 comprises a spiral wound wire 42 embedded in, or attached to, circumferentially spaced elongate supports 44 extending between the end plates 34, 36. Filtration openings or slots 46 are thus provided between adjacent loops of the wire 42. The wire 42 has, adjacent the openings or slots 46, surfaces 47 which taper away from each other, in the direction of the collecting zone 33. The wire 42 thus also has surfaces 48 against which a cake of catalyst particles (not shown) will form, as described in more detail hereunder, when liquid product is filtered by the elements 30 as it passes through the slots 46 in the direction of arrow 49. As a result of the tapering surfaces 47, solid catalyst particles will not readily permanently clog or impregnate the openings or slots 46 when primary filtrate passes through in the direction of the arrow 49.

Typically, the filter elements 30 have an external diameter of 2 to 12 cm, with the wire 42 being of stainless steel. The width of the wire 42 at its base is typically about 1.2 mm, but preferably is 0.8 mm or 0.5 mm. This ensures a lower variation in the width of the slots and reduces the number of openings in excess of the average slot width. The average widths of the slots or openings 46 are typically from 10 to 25 microns, but preferably are not greater than 20 microns. The greater the variation in the gap size and the greater the maximum gap size of the filtering medium 32, the greater the possibility of particles larger than the average gap size passing through the filter media 32. Those versed in the art of filtration know that this will reduce the separation efficiency of the filtration system. It was found that this variation also increased the potential for blinding of the filters during backflushing as catalyst particles can become irreversibly lodged in the downstream side of the filter media 32.

Instead of the filter elements 30, any other suitable elongate filter elements or cartridges, such as ceramic or sintered metal filter elements, can be used.

The filtration zone 22 is preferably located at a high enough level within the slurry bed 14, so that the filter elements 30 are located outside the zone of settled catalyst if the gas supply through the conduit 18 is interrupted. As a result, they will not be embedded in settled solids or catalyst on slumping of the bed 14. However, it has been found that the filtration zone 22 need not necessarily be located near the top of the slurry bed 14 but can instead be located lower down since, should such bed slump occur, permanent clogging of the filter elements 30 may still not readily occur even if the elements 30 are completely surrounded by settled solids or catalyst. The filter elements 30 are preferably located at a low enough elevation so that they remain submerged in liquid and are not exposed to gas if the gas supply is interrupted, but filter exposure is acceptable if the filter surface is shaped so as to avoid catalyst laydown.

The elements 30 are preferably located with their outlets 40 directed downwardly so that any catalyst which passes through the slots 46 with the filtrate (liquid product) will tend to collect in the bottom of the collection zones 33 of the filter elements 30 from where they will be washed out with the primary filtrate.

To the outlet 40 of each of the filter elements 30 is connected a first conduit 51, fitted with a restriction orifice 50. The conduits 51 of all the filter elements 30 making up a bank of the elements tie into a common second conduit 53 fitted with a shut-off valve 52. All the conduits 53 tie into a common third conduit 54, fitted with a quick opening valve 56.

The conduit 54 leads into a primary filtrate blowdown vessel or drum 58 and is provided with a shut-off valve 60. A conduit 62 leads from the drum 58 to a secondary filtration stage 64 comprising horizontally orientated pressure leaf filters, such as Schenk (trademark) filters. A residue withdrawal line 66 leads from the stage 64 as does a secondary filtrate withdrawal line 68. The line 68 is fitted with a shut-off valve 70.

The conduit 68 leads into a secondary filtrate blowdown vessel 72. A liquid runout conduit 74, fitted with a shut-off valve 76, leads from the vessel 72.

The vessel 12 includes at least one downcomer 90 located within the slurry bed 14. A cooling coil 92 is also provided within the vessel 12 located within the slurry bed 14.

If desired, the downcomer 90 may be provided in a first downcomer region, with the vessel 12 also including a second downcomer region (not shown), staggered vertically with respect to the first downcomer region. At least one downcomer (not shown) will then be provided in the second downcomer region, with its downcomer not being aligned axially with the downcomer 90.

The gas withdrawal flow line 23 leads to a condenser 78. A conduit 80 connects the condenser 78 to a three-phase splitter or separator 82. A tail gas line 84, a condensate line 88, and a reaction water line 86 lead from the separator 82. The condensate line 88 leads via a pump 94 to an oxygenates removal stage 96. A condensate withdrawal line 98 splits from the condensate line 88 before the oxygenates removal stage 96. A backflush condensate line 100 leads from the oxygenates removal stage 96 to the tertiary conduit 54. A shut-off valve 102 is provided in the backflush condensate line 100.

In use, synthesis gas, comprising mainly carbon monoxide and hydrogen, enters the reactor vessel 12 along the flow line 18. The gas flow rate to the vessel 12 is such as to give a maximum superficial gas velocity in the filtration zone 22, based on the open cross-sectional area of the filtration zone 22, of between 5 and 70 cm/s, typically about 30 to 40 cm/s.

The slurry bed 14 is maintained in the reactor vessel 12. The slurry bed 14 comprises catalyst particles suspended in liquid product, i.e. liquid wax produced in the vessel 12 on reaction of the gaseous reactants. The catalyst particles are maintained in suspended state in the slurry bed 14, and in particular in the filtration zone 22, by means of the turbulence created therein by the gas passing upwardly therethrough. It is believed that this turbulence also inhibits excessive cake build-up on the filtering media 32, and thus enhances filtration through the media 32.

The vessel 12 is maintained at an operating pressure of between 20 bar and 30 bar, typically about 25 bar, and at an operating temperature between 180° C. and 260° C., typically between about 220° C. and about 240° C. However, the operating pressure can be in excess of 25 bar, and the operating temperature higher than 240° C. or lower than 220° C., as hereinbefore described, depending on the nature and spread of gaseous and liquid products required and the type of catalyst used. Naturally, the vessel 12 will be provided with suitable temperature control means, such as the cooling coil 92 for controlling the reaction temperatures, as well as suitable pressure control means such as a pressure control valve.

In the vessel 12, as the synthesis gas passes through the slurry bed 14, the carbon monoxide and hydrogen react to form a range of products in accordance with known Fischer-Tropsch reactions. Some of these products are in gaseous form at the operating conditions of the vessel 12 and are withdrawn, together with unreacted synthesis gas, along the flow line 23. Some of the products produced, such as the waxes already mentioned, are in liquid form at the operating conditions of the vessel 12, and act as the suspension medium for the catalyst particles. As liquid product is formed, the level 16 of the slurry bed naturally rises, and the liquid product is thus withdrawn as primary filtrate in the filtration zone by means of the filter elements 30 and blowdown vessel 58 to maintain the slurry bed level. Typically the pressure in the vessel 58 is set such that the pressure differential across the filtering media 32 of the filtering elements 30 and any filter cake build up thereon, is about 2 to 4 bar. This internal filtration constitutes a first stage of the operating cycle of the filter elements 30.

In this fashion, a relatively constant slurry bed level in the reactor vessel 12 is maintained. However, when the filter cake has built up to some thickness, it must then be backflushed from the filtering media, in a second stage of the operating cycle of the filter elements 30.

The catalyst used is typically an iron- or cobalt-based catalyst, and a product mixture comprising liquid product and catalyst particles having a range of sizes is formed in the slurry bed. The product mixture will contain a range of catalyst particle sizes. Large catalyst particles will not pass through the filtering openings 46 of the filter elements 30 and will build up as a cake on the outside of the filter elements 30. Primary filtrate comprising liquid product and catalyst particles that have passed through the filtering openings, flows by means of the conduits 53 and 54, into the vessel 58. From there it passes through the secondary filtration stage 64 where at least a portion of the catalyst particles in the primary filtrate are removed from the primary filtrate to form secondary filtrate. The secondary filtrate passes from the secondary filtration stage 64, by means of the line 68, into the vessel of drum 72. The vessel 72 is maintained at elevated pressure.

The gaseous products and unreacted synthesis gas, withdrawn along the flow line 23, enter the condenser 78 where the gas is cooled, forming a mixture of hydrocarbon condensate, so-called reaction water and uncondensed tail gas. The mixture is passed to the three-phase separator 82, which separates the condensate, reaction water and tail gas. The tail gas is withdrawn along the tail gas line 84 and the reaction water is withdrawn along the reaction water line 86. The condensate passes along the condensate line 88, via the pump 94, to the oxygenates removal stage 96.

In the oxygenates removal stage 96, oxygenates, such as carboxylic acids and alcohols that could possibly attack the Fischer-Tropsch catalyst, are removed from a portion of the condensate to a level that is not detrimental to the Fischer-Tropsch catalyst, the remainder of the condensate being withdrawn through the condensate withdrawal line 98. In certain embodiments of the invention, substantially all oxygenates are removed from the condensate. In one embodiment of the invention, the condensate is hydrogenated in the oxygenates removal stage 96, thereby to remove oxygenates. If a hydrogenation catalyst is used, care should be taken that a catalyst is not used that requires the addition of dimethyl disulphide to maintain catalyst activity, as the hydrogenated condensate will then contain sulphur which is a known poison to Fischer-Tropsch catalysts.

In a second embodiment of the invention, the oxygenates may be removed from the condensate in the oxygenates removal stage 96 by a solvent extraction process, followed by a guard bed to remove oxygenates down to a very low part per million level. A liquid-liquid extraction process taking place in an extraction column using a mixture of methanol and water as a solvent, may be employed. Such a process may result in an over-all recovery of olefins and paraffins of more than 90%, with the de-oxygenated hydrocarbon condensate then being suitable for use as a backflush medium.

The backflushing is effected by shutting the quick-opening valve 56 and the valve 60 and providing pressurised backflush condensate, e.g. by means of a pump (not shown), in the backflush condensate line 100. Backflushing is effected in pulse-like fashion on one bank of filter elements 30 at a time, using backflush condensate from the backflush condensate line 100. Thus, during backflushing, one of the valves 52 will be open, with the remaining valves 52 closed. The valve 102 will be open. In a first backflushing step, the quick-opening valve 56 opens rapidly in less than 0.8 seconds; a volume of backflush condensate, typically at least equivalent to the internal volume of the filter elements 30 making up the bank of elements being flushed, and more preferably more than 3 times the combined internal volume of the filter elements 30 being backflushed, is allowed to pass from the backflush condensate line 100 into the third conduit 54; this backflush condensate flows through the conduits 54, 53 and 51, and constitutes flushing liquid which passes through the bank of elements 30 in a second direction opposite to the direction in which the product flows during filtering. This typically takes up to 30 seconds. Thereafter, the quick-opening valve 56 is again shut.

If a second backflushing step is desired, the quick-opening valve 56 is again opened rapidly for a second time. The valve 56 is thereafter again closed. If desired, at least one further similar backflushing step can be effected on that particular bank of filter elements.

The remaining banks of elements can then similarly be backflushed, by opening and closing the appropriate valves 52.

Thereafter, in the third stage of the operating cycle of each bank of filter elements 30, the filter elements are subjected to a waiting period in which no liquid passes through them. The Applicant has found that the filtration rate, when the filter elements 30 are then thereafter again subjected to filtration as hereinbefore described, increases with an increase in the duration of the waiting or non-active period. However, this must be balanced against the disadvantage that the filter elements 30 are out of service during these waiting times. It has been found that a waiting period of between 10 and 30 minutes gives good results. However, the waiting period can also be shorter than 10 minutes. It is believed that, during this waiting period, catalyst cake which has been loosened from the filter media 32 of the elements 30 and partially broken up during the backflushing stage, is effectively broken up further, removed from the filter media surfaces and re-mixed remotely from the filters 30, by means of the turbulence within the slurry bed 14. It is believed further that the gas superficial velocity through the filtration zone 22 may influence the optimum duration of the waiting period.

Some slurry continuously passes downwardly through the downcomer 90, thereby to achieve uniform redistribution of catalyst particles within the slurry bed 14, and also to ensure uniform heat distribution throughout the slurry bed, as also described in more detail hereunder.

The vessel 12 is operated so that the slurry bed 14 thereof is in a heterogeneous or churn-turbulent flow regime and comprises a dilute phase consisting of fast-rising larger bubbles of gaseous reactants and gaseous product which traverse the slurry bed virtually in plug flow fashion, and a dense phase which comprises liquid product, solid catalyst particles and entrained smaller bubbles of gaseous reactants and gaseous product.

The backflush condensate line 100 together with the conduits 54, 53 and 51 and the valves 102, 56 and 52 thus together constitute backflushing means. However, it is to be appreciated that instead of using, for backflushing, the conduits 54 and 53 and the valves 56 and 52 which are used for filtration, a separate or dedicated backflushing conduit arrangement (not shown) feeding backflush condensate from the oxygenates removal stage 96 to the filter elements 30, together with associated valves, can be provided.

An advantage of the process 10 is that the hydrocarbon condensate is free of catalyst particles, thereby greatly reducing the risk of blinding the primary filtration surfaces on a downstream side thereof. Advantageously, since at least a major portion of the hydrocarbon condensate again leaves the vessel 12 as a vapour, it does not have a negative effect on the filtration efficiency. Also advantageously, the vaporisation of the condensate from the vessel 12 acts as a form of heat removal from the slurry bed 14. Naturally however, this will result in the duty of the condenser 78 increasing.

The hydrocarbon condensate from the separator 82 includes oxygenated components, such as carboxylic acids and alcohols, that may attack the catalyst. The oxygenates removal stage 96 advantageously removes these components providing a backflush condensate which is safe for use in the vessel 12.

The invention claimed is:

1. A hydrocarbon synthesis process for producing liquid and gaseous products from gaseous reactants, which process includes feeding, at a low level, gaseous reactants into a slurry bed of solid catalyst particles suspended in a suspension liquid;

allowing the gaseous reactants to react catalytically as they pass upwardly through the slurry bed, thereby to form liquid and gaseous hydrocarbon products, with the reaction being catalysed by the catalyst particles, and with a product mixture comprising liquid product and catalyst particles being formed;

subjecting, in a filtration stage, the product mixture to filtration by passing the liquid product through a filtering medium in a first direction to separate catalyst particles from the liquid product;

withdrawing the gaseous products from above the slurry bed;

cooling the gaseous products to form a multi-phase product comprising at least a hydrocarbon condensate and a tail-gas;

separating the multi-phase product to produce at least a hydrocarbon condensate stream and a tail-gas stream;

treating at least a portion of the hydrocarbon condensate stream to remove oxygenated components therefrom, producing a backflush condensate;

from time to time interrupting for periods the passage of liquid product through the filtering medium of the filtration stage; and backflushing the filtering medium of the filtration stage by passing the backflush condensate through the filtering medium in a second direction opposite to the first direction, for at least a portion of the periods that the liquid product passage is interrupted.

2. The process as claimed in claim 1, in which the hydrocarbon synthesis is Fischer-Tropsch hydrocarbon synthesis, with the gaseous reactants being in the form of a synthesis gas stream comprising mainly carbon monoxide and hydrogen, with the catalyst particles being Fischer-Tropsch catalyst particles, with the multi-phase product comprising at least said hydrocarbon condensate and said tail gas and reaction water, and in which the multi-phase product is separated to produce said hydrocarbon condensate stream and said tail gas stream and a reaction water stream.

3. The process as claimed in claim 1, in which treating at least a portion of the hydrocarbon condensate stream to remove oxygenated components includes subjecting said portion of the condensate stream to hydrogenation, using a hydrogenation catalyst.

4. The process as claimed in claim 3, in which the hydrogenation catalyst does not require dimethyl disulphate injection to maintain hydrogenation catalyst activity.

5. The process as claimed in claim 1, in which treating at least a portion of the hydrocarbon condensate stream to remove oxygenated components includes subjecting said portion of the condensate stream to solvent extraction.

6. The process as claimed in claim 1, in which treating at least a portion of the hydrocarbon condensate stream to remove oxygenated compounds includes passing said portion of the hydrocarbon condensate stream through a guard-bed to remove oxygenated components from the condensate to a concentration of less than 200 ppm.

7. The process as claimed in claim 1, which includes, in a separation stage, separating lighter components from the backflush condensate to form a lights removed backflush condensate, and then using the lights removed backflush condensate for backflushing.

8. The process as claimed in claim 7, in which the separation stage includes at least one distillation operation.

9. The process as claimed in claim 1, in which at least a portion of the backflush condensate used to backflush the filtering medium is withdrawn in gaseous form together with the gaseous products from above the slurry bed, thereby removing heat from the slurry bed.

* * * * *